United States Patent [19]

Patton et al.

[11] 4,150,708

[45] Apr. 24, 1979

[54] APPARATUS AND METHOD OF MAKING FILAMENTS

[75] Inventors: Robert J. Patton, Westford; Martin P. Schrank, Ipswich, both of Mass.

[73] Assignee: GTE Sylvania Incorporated, Danvers, Mass.

[21] Appl. No.: 857,267

[22] Filed: Dec. 5, 1977

[51] Int. Cl.[2] ..... B22D 11/06

[52] U.S. Cl. ..... 164/72; 164/87; 164/423; 164/427

[58] Field of Search ..... 164/46, 72, 75, 87, 164/267, 268, 423, 427; 249/115; 427/251; 264/169, 213, 164, 165, 176 F; 428/652; 222/413

[56] References Cited

U.S. PATENT DOCUMENTS

| | | | |
|---|---|---|---|
| 938,689 | 11/1909 | Nichols | 164/75 |
| 2,702,760 | 2/1955 | Barth | 427/251 |
| 3,029,777 | 4/1962 | Cerych et al. | 427/251 |
| 3,181,209 | 5/1965 | Smith, Jr. | 164/46 |
| 3,306,716 | 2/1967 | Adler | 428/652 |
| 3,471,321 | 10/1969 | Oualline, Jr. et al. | 427/251 |
| 3,540,517 | 11/1970 | Wojcik | 164/72 |
| 3,843,762 | 10/1974 | Sleigh | 164/87 |
| 3,896,203 | 7/1975 | Maringer et al. | 164/87 |
| 4,036,411 | 7/1977 | Westhoff | 222/413 |

FOREIGN PATENT DOCUMENTS

| | | | |
|---|---|---|---|
| 1125595 | 3/1962 | Fed. Rep. of Germany | 164/72 |
| 508295 | 6/1939 | United Kingdom | 249/115 |

*Primary Examiner*—Othell M. Simpson
*Assistant Examiner*—K. Y. Lin
*Attorney, Agent, or Firm*—Lawrence R. Fraley

[57] ABSTRACT

An improved apparatus and method for making solid filamentary elements from a pendant drop of a high melting point material (e.g. hafnium, zirconium). The improvement constitutes providing a protective layer in the form of a thin film on the circumferential edge of the casting wheel prior to engagement of the drop and release of the elements. The layer material serves to reduce heat flow from the drop material to the wheel as well as prohibit bonding of the drop material thereto. The preferred layer materials are aluminum, carbon (e.g. graphite), boron nitride, and borosilicate glass.

17 Claims, 4 Drawing Figures

APPARATUS AND METHOD OF MAKING FILAMENTS

BACKGROUND OF THE INVENTION

The invention relates to the making of filaments and particularly to filament production wherein an elongated rod has a pendant drop formed thereon which is engaged by a rotating heat extractor, such as a copper wheel-like member (e.g. disc).

Even more particularly, the invention relates to the above subject matter wherein filaments are produced from rods of high melting point material, e.g. those having melting points exceeding 1200° Celsius.

With regard to the present invention, the term filament is meant to define slender, elongated metallic elements having a transverse dimension less than the element's length dimension. Examples of such elements include sheet, ribbon, or wire. One particular use for these products is as the combustible fill material within a photoflash lamp such as described in U.S. Pat. Nos. 3,535,063 (L. F. Anderson et al), 3,897,196 (J. P. Saunders et al), and 4,008,040 (D. E. Murray et al), all of which are assigned to the assignee of the present invention. The combustible fill material readily ignites upon activation to provide the intense flash typically associated with photoflash applications. At least two methods are presently used to produce elongated filaments from rods of metallic material. The first involves forming a suspended drop on the end of a vertically oriented rod and engaging the drop from below with a rotating copper disc. Such a process is described in U.S. Pat. No. 3,896,203 (Maringer et al). The disc has a chill surface which has a coefficient of thermal conductivity sufficient to withdraw heat from the molten drop in such rapid fashion so as to form the filamentary element on the surface of the drop. The filament is thereafter emitted and collected for further use.

A second method of producing metallic filaments from rods involves formation of what is termed a sessile drop. By a sessile drop is meant one which is substantially upwardly projected using suitable means to engage a rotating casting disc located above the drop. In other words, the rod and disc are inverted in comparison to the arrangement used in the aforementioned suspended drop process. With regard to the present invention, the term pendant drop will be used and is meant to include both suspended and sessile drops.

One particular problem which occurs in the production of filamentary elements from a pendant drop of molten material concerns the damage (e.g. pits, scratches) which occurs on the casting disc's circumferential edge. The resulting erosion of this surface adversely affects filament release, which results in discontinuity of size and surface configuration of these elements. Additionally, the higher the temperature of the disc's edge, the more rapidly this edge erodes.

From the foregoing background, it can be understood that an apparatus and method which produce dimensionally consistent filaments from a pendant drop of high melting point material and which assure substantial prevention of damage to the circumferential edge of the casting wheel would constitute significant advancements in the art.

OBJECTS AND SUMMARY OF THE INVENTION

It is, therefore, a primary object of this invention to enhance the production of filamentary elements by providing an apparatus and method which overcome the several aforementioned problems inherent in many apparatus and methods of the prior art.

According to one aspect of the invention, there is defined an improved method of producing solid filamentary elements from a pendant drop of molten material. The method involves engaging the drop with the circumferential edge of a rotating wheel-like, heat-extracting member (e.g. copper disc), solidifying the molten material on the edge to form the filamentary elements, and thereafter releasing the elements from the edge. The improvement to the method comprises applying a thin protective layer of material to the circumferential edge prior to said engagement with the drop and subsequent to release of the filament, said material adhering during these periods of engagement and release.

In accordance with another aspect of the invention, an improved apparatus for producing filamentary elements is defined. The apparatus includes means for heating the filament material to form a molten pendant drop, a wheel-like, heat-extracting member having a circumferential edge thereon for engaging the molten drop, and means for rotating the heat-extracting member to effect said engagement and the resulting solidification of molten material thereon and release of the formed filamentary elements therefrom. The improvement to the apparatus comprises means for applying a thin protective layer to the edge of the heat-extracting member prior to engagement with the molten drop and after release of the solidified filaments, this material adhering during the engagement and release of the filaments.

DETAILED DESCRIPTION OF THE PREFERRED EMBODIMENTS

For a better understanding of the present invention together with other and further objects advantages and capabilities thereof, reference is made to the following disclosure and appended claims in connection with the above-described drawings.

Figure 1:
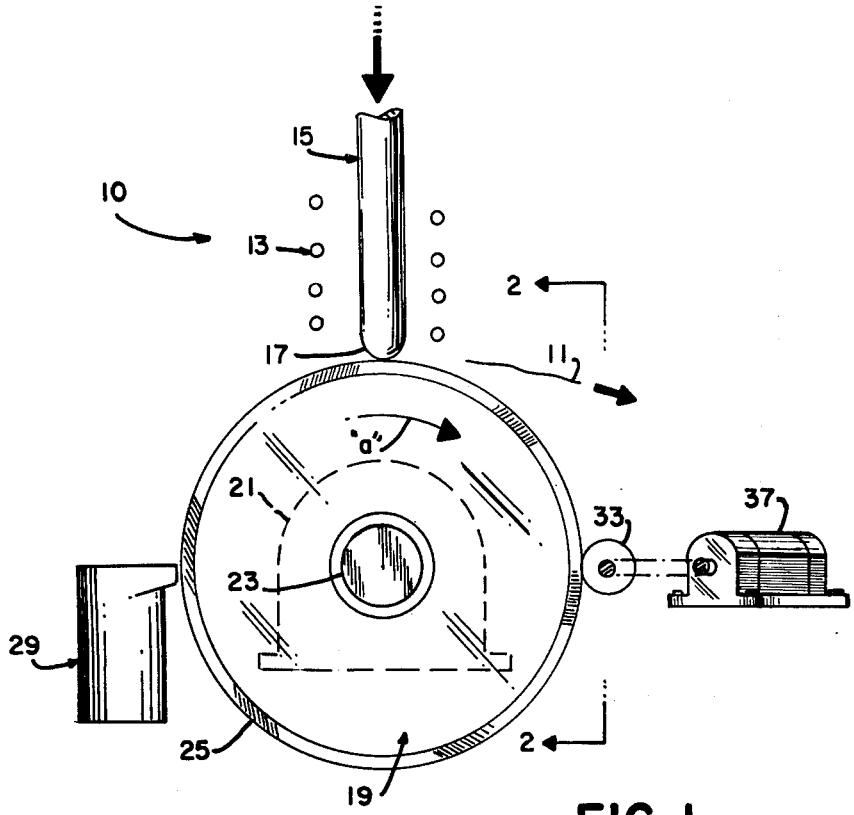
FIG. 1 is a front elevational view of a filament-producing apparatus in accordance with one embodiment of the invention.

In FIG. 1 is shown an apparatus 10 for forming solid filamentary elements 11 (one shown). The apparatus includes means 13 for heating the rodlike material 15 to form a pendant drop 17 thereon. Material 15 is preferably a high melting point (e.g. above 1200° Celsius) material, two examples being hafnium and zirconium. Heating means 13 is preferably an induction coil but may instead comprise a gas torch, an electrical resistance heater, a focused arc, etc.

Figure 2:
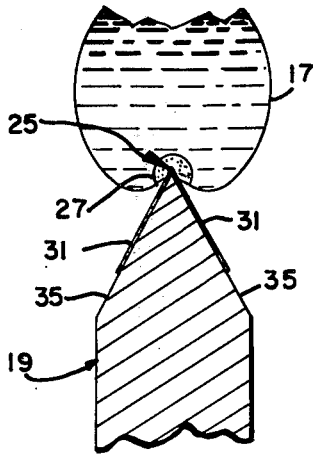
FIG. 2 is an enlarged side view, in section, of a portion of the apparatus of FIG. 1 as taken along the line 2—2 in FIG. 1.

Apparatus 10 further includes a rotating wheel-like, heat-extracting member 19 (e.g. a copper disc) which rotates in the direction indicated as "a". This rotational movement is provided by a suitable drive means 21 (e.g. electric motor) which is operatively connected to disc 19 by a drive shaft 23. As disc 19 rotates, the circumferential edge 25 of this member engages the molten pendant drop 17. Because disc 19 is cooled, part of the material (see No. 27 in FIG. 2) from drop 17 becomes solidified and is thereafter released from edge 25 in the form of filamentary element 11.

The improvement to apparatus 10 involves providing a means 29 for applying a thin film protective layer 31 to edge 25 of disc 19 during the disc's rotation. Layer 31 is preferably of uniform thickness (e.g. 20 to 200 nanometers thick). Examples of materials sucessfully used for layer 31 include aluminum, carbon (e.g. graphite), boron nitride, and borosilicate glass. By protective is meant a material which: (1) forms a weakly bonded layer on the edge of the disc; (2) reduces heat flow from the molten drop 17 to disc 19; (3) prevents bonding of the molten drop material in solidified form to the disc's edge 25; (4) does not alter in any manner the surface configuration of the solid filamentary element which would ordinarily result if layer 31 were omitted. In other words, layer 31 is of substantially the same degree of smoothness as the original surface of edge 25. With regard to the invention, it is preferred that layer 31 be applied in such a manner that it may be readily removed subsequent to the release of filamentary elements 11. The release point of elements 11 in FIG. 1 is immediately to the right of drop 17. In other words, it is highly preferred in the present invention that elements 11 have a relatively short dwell time (period of adherence to edge 25). For a disc having a diameter of 8 inches and a rotational speed of 500 revolutions per minute, a dwell time of only about 0.001 seconds is preferred. This period is equivalent to an arc on disc 19 having a dimension of about 0.35 inches. A filamentary element produced under these conditions has a length of about 10 inches and a cross-sectional area from about $1\times10^{-6}$ to $1\times10^{-5}$ square inch.

As stated, layer 31 adheres to edge 25 during the engagement of drop 17 by edge 25 and the subsequent release of elements 11. As also stated, layer 31 is applied in such a manner that it may be easily removed after the aforementioned release. One method of accomplishing the removal (shown in FIG. 1) comprises using at least one honing wheel 33 which engages edge 25. Should disc 19 be tapered (e.g. V-shaped) and include a pair of angled sides (35 in FIG. 2), removal means 33 would include two honing wheels, one for each side 35. In this arrangement, each wheel would comprise a 5-inch diameter abrasive (e.g. silicon carbide) disc which is glued to a layer of foam plastic which in turn is bonded to a steel disc. Wheels 33 are preferably rotationally driven (e.g. by a variable speed motor 37) during the aforedescribed removal. The above represents only one form of removing layer 31 and is therefore not meant to limit the invention. In one trial run of apparatus 10, it was possible to remove layer 31 using the operator's thumb and wiping it along one of the sides 35.

Figure 3:
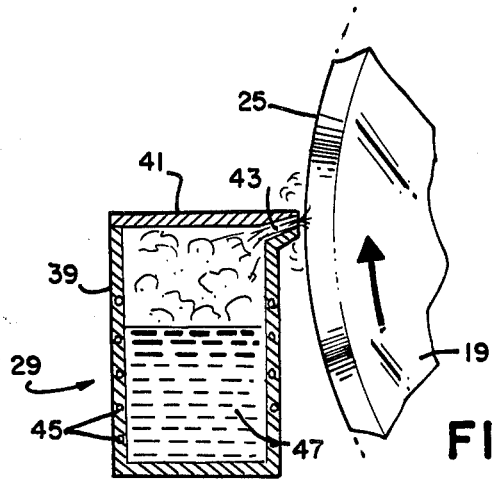
FIGS. 3 and 4 depict various embodiments of means for applying a protective layer to the wheel-like, heat-extracting member of the invention.
Figure 4:
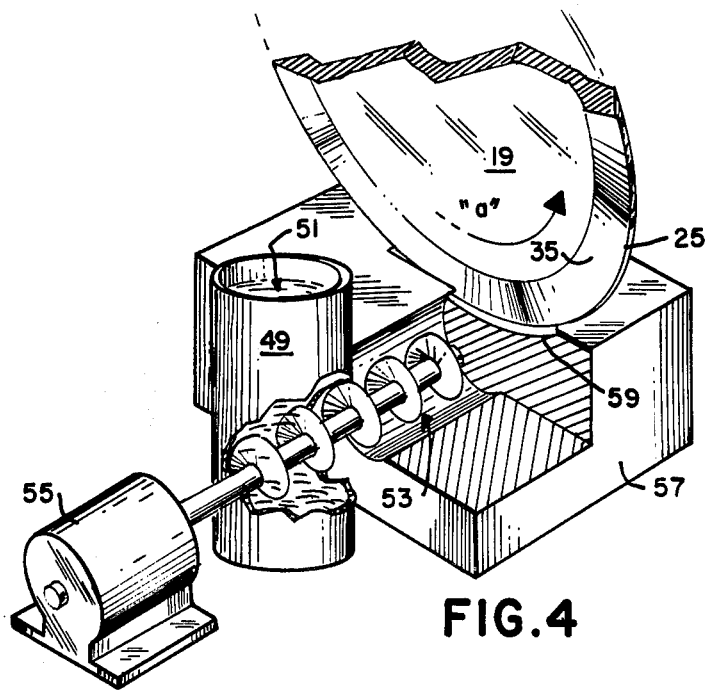

In FIGS. 3 and 4, various embodiments of layer applicators are shown. The embodiment of FIG. 3, which is similar to that shown in FIG. 1, comprises an enclosed container 39 having a removable top 41 and a slot or opening 43 therein. A resistance heating coil 45 is located within the walls of container 39 and serves to heat the material 47 which will become the desired protective layer. Coil 45, preferably tungsten, heats material 47 to the vapor state whereupon the vapor passes through opening 43 and adheres to edge 25 of disc 19. The preferred material 47 in FIG. 3 is aluminum.

The embodiment of FIG. 4 comprises a container 49 in which the surface layer material 51, in dry powder form, is located. An auger 53, powered by an electric motor 55, passes through container 49 and an adjacent housing 57 (shown partly in section). A slot 59, shaped to match the contour of disc 19, is formed within housing 57 and receives the powder material 51 from auger 53. In operation, slot 59 becomes substantially filled with material 51 which presses firmly against the edge 25 and sides 35 of disc 19 as the disc rotates therein (in direction "a"). The preferred material 51 for use in FIG. 4 is boron nitride.

There has thus been shown and described an apparatus and method for applying a thin film layer of material to the circumference edge of a rotating heat-extracting member (disc) in order to protect the edge from the damage typically associated with high temperature fiber casting operations. The layer prevents diffusion bonding of the molten material to the disc's surfaces in addition to providing a boundary layer to substantially reduce heat flow from the molten drop to the disc. The described layer materials as successfully used with the invention do not alter the surface of the formed elements in any manner and therefore assure a degree of smoothness on the disc's edge as originally provided. In the event that damage (e.g. pits, scratches, etc.) has occurred to the edge, the layer materials as defined are further capable of filling in such voids and therefore maintaining the above smoothness. It is understood from the foregoing description that the layer materials as defined will not chemically attack the resulting filaments nor will such materials, at the state of application, adversely affect the environment about apparatus 10. Accordingly, these materials are therefore "sacrificed" during the solidification and release stages of filament production and may be released as part of each filamentary element. In this event, a subsequent step in the process would be included to separate the two materials, if desired.

While there have been shown and described what are at present considered the preferred embodiments of the invention, it will be obvious to those skilled in the art that various changes and modifications may be made therein without departing from the scope of the invention as defined by the appended claims.

What is claimed is:

1. In a method of forming solid filamentary elements from a pendant drop of molten material wherein said method includes engaging said pendant drop of molten material with the circumferential edge of a rotating wheel-like, heat-extracting member, solidifying said molten material on said circumferential edge to form said solid filamentary elements, and releasing said elements from said edge, the improvement comprising:

applying an easily removable protective layer in the form of a thin film of solid material to said circumferential edge of said heat-extracting member at a location prior to the position of engagement with said pendant drop and after the position of release of said filamentary elements, said protective layer adhering to said edge during the periods of said engagement and release.

2. The method according to claim 1 wherein said protective layer is vapor deposited on said circumferential edge.

3. The method according to claim 1 wherein said protective layer is removed from said circumferential edge after release of said filamentary elements.

4. The method according to claim 3 wherein said protective layer is removed by honing.

5. The method according to claim 1 wherein said molten material is a high melting point material.

6. The method according to claim 5 wherein said molten material is selected from the group consisting of zirconium and hafnium.

7. The method according to claim 6 wherein the material of said protective layer is selected from the group consisting of aluminum, boron nitride, carbon, and borosilicate glass.

8. The method according to claim 7 wherein said wheel-like, heat-extracting member is comprised of copper.

9. The method according to claim 1 wherein said protective layer is applied to said circumferential edge by wiping.

10. The method according to claim 9 wherein the material comprising said protective layer is in powder form at the time of said application to said circumferential edge.

11. In an apparatus for forming solid filamentary elements from a pendant drop of molten material wherein said apparatus includes heating means, said heating means heating said material to produce said molten drop thereon, a rotating, wheel-like, heat-extracting member located adjacent said heating means and having a circumferential edge thereon, said edge engaging said molten drop during rotation of said wheel-like, heat-extracting member and solidifying portions of said molten material to form said filamentary elements, said elements thereafter released from said edge, and rotating means operatively connected to said heat-extracting member, said rotating means rotating said heat-extracting member, the improvement comprising:

layer application means comprising a vapor producing assembly located adjacent said heat-extracting member, said vapor producing assembly applying an easily removable protective layer in the form of a thin film of solid material to said circumferential edge of said heat-extracting member at a location prior to the position of engagement with said pendant drop and after the position of release of said filamentary elements, said protective layer adhering to said edge during the periods of said engagement and release.

12. The apparatus according to claim 11 wherein said vapor producing assembly comprises an enclosed container having therein the material to form said layer and including at least one opening therein located adjacent said edge of said heat-extracting member, and heating means, said heating means heating said material within said container to a vapor state, said vapor passing through said opening and adhering to said circumferential edge.

13. The apparatus according to claim 12 wherein said means for heating said layer material to a vapor state comprises an electrical resistance heater located within the walls of said container.

14. The apparatus according to claim 11 further including protective layer removal means, said removal means located adjacent said heat-extracting member during rotation of said heat-extracting member, said removal means removing said protective layer after release of said filamentary element from said circumferential edge.

15. The apparatus according to claim 14 wherein said protective layer removal means comprises at least one honing wheel.

16. In an apparatus for forming solid filamentary elements from a pendant drop of molten material wherein said apparatus includes heat means, said heating means heating said material to produce said molten drop thereon, a rotating, wheel-like, heat-extracting member located adjacent said heating means and having a circumferential edge thereon, said edge engaging said molten drop during rotation of said wheel-like, heat-extracting member and solidifying portions of said molten material to form said filamentary elements, said elements thereafter released from said edge, and rotating means operatively connected to said heat-extracting member, said rotating means rotating said heat-extracting member, the improvement comprising: layer application means located adjacent said heat-extracting member, said layer application means applying an easily removable protective layer in the form of a thin film of solid material to said circumferential edge of said heat-extracting member at a location prior to the position of engagement with said pendant drop and after the position of release of said filamentary elements, said protective layer adhering to said edge during the periods of said engagement and release, said layer application means comprises a housing having a slot therein, said edge of said heat-extracting member rotating within said slot, a container located adjacent said housing and having a quantity of the material to form said layer therein in powder form, and supply means passing through said container and housing, said supply means supplying said slot with said powder material from said container, said edge engaging said powder material during said rotation within said slot.

17. The apparatus according to claim 16 wherein said supply means for supplying said powder material to said slot comprises an auger member and means for driving said auger member.

* * * * *